US005152088A

United States Patent [19]

Hahn

[11] Patent Number: 5,152,088

[45] Date of Patent: Oct. 6, 1992

[54] EXCAVATING TOOTH POINT AND METHOD OF REPLACEMENT

[75] Inventor: Frederick C. Hahn, Aloha, Oreg.

[73] Assignee: ESCO Corporation, Portland, Oreg.

[21] Appl. No.: 699,200

[22] Filed: May 13, 1991

Related U.S. Application Data

[63] Continuation-in-part of Ser. No. 580,850, Sep. 10, 1990, Pat. No. 5,074,062.

[51] Int. Cl.[5] ..... E02F 9/28

[52] U.S. Cl. ..... 37/142 A; 37/141 T

[58] Field of Search ..... 37/141 T, 142 A, 142 R; 299/92; 172/772, 753

[56] References Cited

U.S. PATENT DOCUMENTS

| | | | |
|---|---|---|---|
| Re. 33,042 | 9/1988 | Emrich . | |
| 564,664 | 7/1896 | Trim et al. | 37/142 R |
| 2,702,490 | 2/1955 | Launder . | |
| 3,312,003 | 4/1967 | Troeppl et al. | 37/142 A |
| 3,323,235 | 6/1967 | Petersen | 37/142 A |
| 3,400,476 | 9/1968 | Petersen | 37/142 A |
| 3,520,076 | 7/1970 | Nichols . | |
| 3,520,224 | 7/1970 | Hensley et al. . | |
| 3,526,049 | 9/1970 | Nichols . | |
| 3,526,435 | 9/1970 | Krekeler | 37/142 A |
| 3,894,349 | 7/1975 | Moreau | 37/142 A |
| 4,155,665 | 5/1979 | Kaarlela . | |
| 4,192,089 | 3/1980 | Schwappach . | |
| 4,335,532 | 6/1982 | Hahn et al. . | |
| 4,404,760 | 9/1983 | Hahn et al. | 37/142 R |
| 4,505,058 | 3/1985 | Peterson | 37/142 A |
| 4,516,340 | 5/1985 | Launder | 37/142 A |
| 4,577,423 | 3/1986 | Hahn . | |
| 4,761,900 | 10/1988 | Emrich | 37/142 A |
| 4,811,505 | 3/1989 | Emrich | 37/142 A |
| 4,823,487 | 4/1989 | Robinson . | |
| 4,903,430 | 2/1990 | Kreitzberg et al. | 37/142 A |
| 4,965,945 | 10/1990 | Emrich . | |
| 5,074,062 | 12/1991 | Hahn et al. | 37/141 T |

*Primary Examiner*—Randolph A. Reese
*Assistant Examiner*—Spencer Warnick
*Attorney, Agent, or Firm*—Tilton, Fallon, Lungmus & Chestnut

[57] ABSTRACT

A novel tooth point, locking pin and method of replacing a worn point wherein the point is held in place by a pin having a resilient laterally outwardly extending projection received in a recess provided in the inner surface of an L-shaped rearwardly extending tongue on the point, the pin having an elastomeric core within a steel jacket.

18 Claims, 2 Drawing Sheets

EXCAVATING TOOTH POINT AND METHOD OF REPLACEMENT

This application is a continuation-in-part of co-pending application Ser. No. 580,850 filed Sep. 10, 1990 now U.S. Pat. No. 5,074,062.

BACKGROUND AND SUMMARY OF INVENTION:

This invention relates to an excavating tooth point and method of replacement and, more particularly, to the use during installation of a novel point and locking pin means.

Since before the turn of the century, excavating teeth have included replaceable points mounted on adapters which, in turn were secured to the digging edge of an excavator. Depending upon the type of excavation, a given adapter can be successively equipped from anywhere from 5 to 30 points to maintain sharp penetrating edges. Historically, the point and nose of the adapter were equipped with vertically aligned openings in which a locking pin was received. An early version is seen in U.S. Pat. No. 564,664. In the early 1980's a new form for securing the point to the adapter was developed as shown in co-owned U.S. Pat. No. 4,335,532. This made use of helical thread means on the point nose and adapter socket with a side-mounted pin means. Subsequently, for smaller sizes of teeth, the pin means was dispensed with and detent means were provided on rearwardly extending tongues as seen in co-owned U.S. Pat. No. 4,557,423. For the larger sizes, an improved side lock was provided as seen in co-owned U.S. Pat. No. 33,042. A novel point for a side locking pin is seen in co-owned U.S. Pat. No. 4,965,945. It has now been found that certain of the smaller sizes function better with a novel point with a modified side pin lock means as described hereinafter.

It will be appreciated that the securement of the point on the adapter is a compromise between two opposing demands. The way of securing must be strong enough during the excavating operation so as to maintain the point on the adapter against the tremendous shock loads encountered. Yet, when replacement is necessary, the means for securement must be readily removed. It will be further appreciated that often the replacement is performed under rather primitive conditions in the field where no assistance equipment is available. Typically, the locking pin has to be removed with only a hammer and drift pin which makes it difficult to overcome a tightly held securement.

According to the invention, the balance of opposing requirements is achieved through the provision of a novel point for side mounted pin where the pin is removed by compressing a sidewardly extending projection received within a recess in the inner surface of a rearwardly-extending tongue on the point.

Other advantages and details of operation can be seen in the ensuing specification.

The invention is described in conjunction with the accompanying drawing, in which.

DETAILED DESCRIPTION

Figure 1:
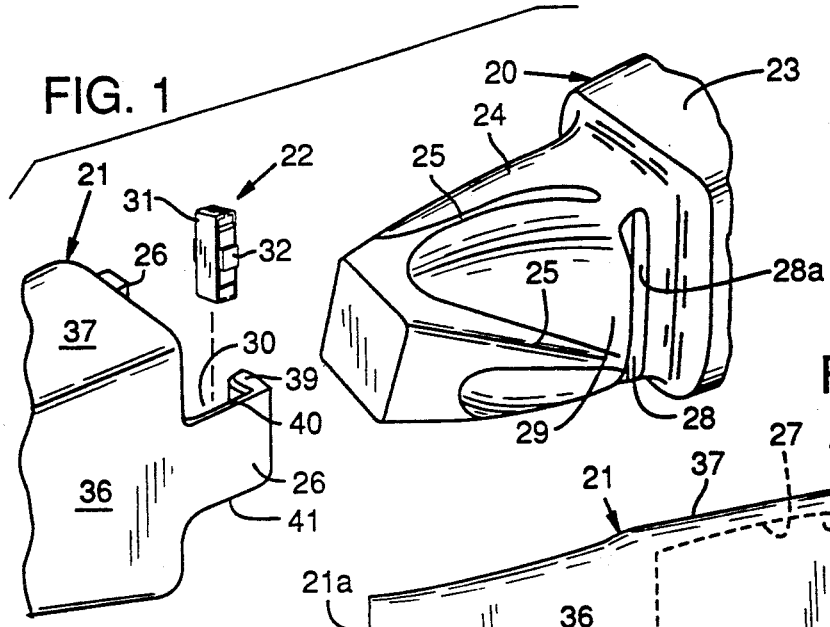
FIG. 1 is a fragmentary exploded view of the invention.
Figure 2:
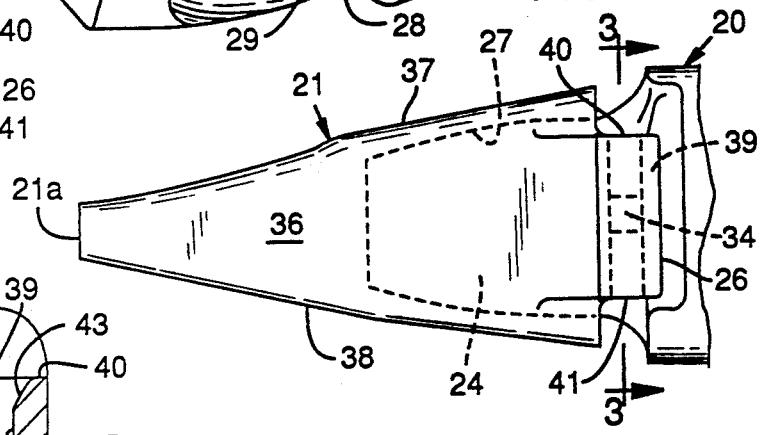
FIG. 2 is a fragmentary side elevational view of the elements of FIG. 1 in partially assembled condition.

In the illustration and reference first to FIG. 1, the numeral 20 designates generally an adapter, the numeral 21 generally designates a point and the numeral 22 generally designates a locking pin. The adapter 20 has a shank portion 23 which normally is bolted, welded, etc. to the lip of an excavator (not shown). Extending forwardly from the shank 23 is the adapter nose 24 which is constructed generally in accordance with the teachings of U.S. Pat. No. 4,335,532, having a plurality of helical threads as at 25. As seen in FIG. 2 the point 21 has a forward earth engaging edge 21*a* and rearwardly extending tongues or ears as at 26 which cooperate with the adapter in receiving the pin lock means 22 of FIG. 1. This can be seen more clearly from a consideration of FIGS. 4 and 5.

Referring now to FIG. 2, it is seen that the nose 24 is received within a conforming socket 27 at the rear end of the point 21. More particularly, the nose has exterior top, bottom and sidewalls in conventional fashion with the helical thread means 25 protruding therefrom. Likewise, in conventional fashion, the socket 27 has similar top, bottom and sidewalls which conform essentially to the exterior walls of the adapter nose 24.

Referring to FIG. 1, the numeral 28 designates a vertically extending slot in the sidewall 29 of the nose 24. This cooperates with the slot 30—still referring to FIG. 1—in the ear 26 of the point 21 for the receipt of the pin lock means 22—see also FIGS. 4 and 5.

Figure 3:
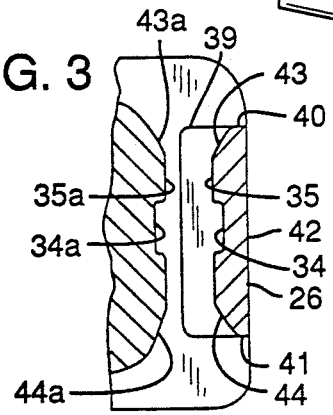
FIG. 3 is a fragmentary sectional view such as would be seen along the sight line 3—3 of FIG. 2.

The locking pin 22 (as designated in FIG. 1) is seen to include a relatively elongated element 31 which is equipped with a side projection 32. As will be explained in detail hereinafter, the projection 32 is provided by a part 33 of a steel jacketed wall—see the right hand portion of FIG. 6. The projection 32 is adapted to be received within a recess 34 (see FIG. 3) provided in the inner surface 35 of the tongue 26. The assembled relationship can be seen in FIG. 4.

For point reversibility, two tongues 26 as seen in FIG. 1 may be provided—one for each sidewall 36. In conventional fashion, the sidewalls 36 extend between and connect the top and bottom walls 37 and 38, respectively—compare FIGS. 1 and 3. In some instances however—for specialized, non-reversible points, only one sidewall 36 is extended rearwardly to provide the tongue 26. Further, each tongue 26 is equipped with integral, inwardly-extending flange means 39—see FIG. 1. In the illustration given, the flange means 39 is developed by slotting the tongue 26 as at 30. The flange means 39 serves to confine the locking pin 22—see FIG. 5 and may either extend from top to bottom of the tongue 26 as shown or may have spaced apart portions such as the inwardly-extending lugs shown in U.S. Pat. No. 4,965,945. Express reference is hereby made to the '945 patent for details not shown herein.

The recess 34 (see FIG. 3) is located intermediate (and preferably midway of) the top surface 40 and the bottom surface 41 of the tongue 26. Advantageously, the inner surface 35 is tapered or angled outwardly toward the outer surface 42 as at 43 and 44 adjacent the top and bottom surfaces 40 and 41, respectively. This facilitates installation of the projection-equipped locking pin 22.

Figure 4:
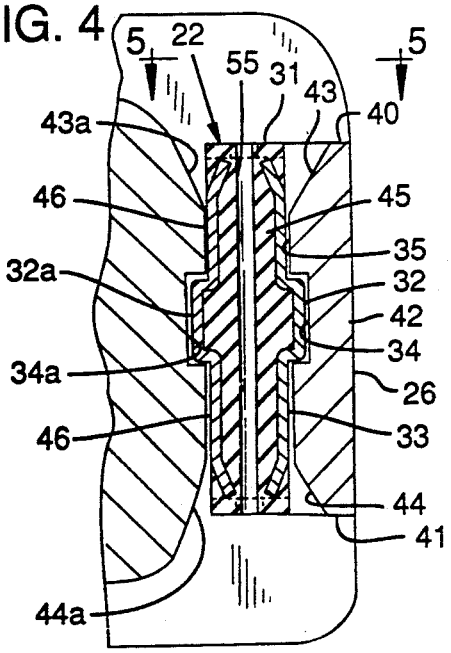
FIG. 4 is an enlarged view similar to FIG. 3 and with the locking pin installed.

It may be advantageous in some instances to provide a second (and opposing) projection 32*a*—see FIG. 4—on the locking pin. This is received within a recess 34*a* in the adapter nose 24—see FIG. 3. In such a case there is no possibility of inserting the pin incorrectly, besides, providing additional bearing engagement. Also of advantage in this arrangement is the provision of end tapers on the nose wall 35*a* as at 43*a* and 44*a*.

Thus, in summary, there is provided a replaceable point for an excavating tooth which includes a relatively elongated, unitary body 21 having an earth engaging edge 21*a* at the forward end thereof and an adapter nose-receiving socket 27 in the rear end and defined by top, bottom and a pair of sidewalls as at 37, 38 and 36. At least one of the sidewalls extends rearwardly beyond the top and bottom walls to provide a rearwardly-extending tongue 26. The tongue at the rear end thereof is equipped with integral, inwardly extending flange means 39. The tongue has top, bottom, inner and outer surfaces as at 40, 41, 35 and 42, respectively. The inner surface 35 is equipped with a recess 34 intermediate the top and bottom surfaces 40, 41 and is adapted to engage a locking pin projection—as at 32. Further, the inner surface 35 adjacent the top surface 40 is angled as at 43 toward the outer surface 42 and optimally the inner surface 35 adjacent the bottom surface 41 is similarly angled as at 44 toward the outer surface 42.

Locking Pin

Figure 6:
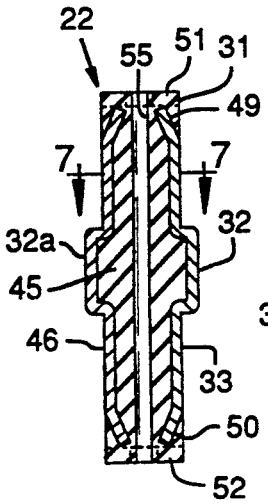
FIG. 6 is a sectional view of the locking pin.
Figure 7:
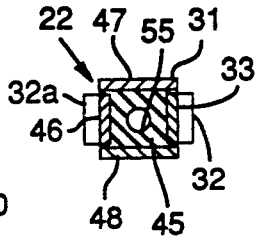
FIG. 7 is a sectional view taken along the sight line 7—7 of FIG. 6.

The details of the relatively elongated locking pin 31 which constitutes the pin lock means generally designated 22 can be appreciated best from a consideration of FIGS. 6 and 7.

Referring to FIG. 7, the pin 31 is an elastomeric sandwich pin with four steel sides which provides advantageous functionality. The core (advantageously of rubber) is designated 45 and is seen to be confined between the previously mentioned side 33 and an opposing side 46. The other two sides are enclosed by steel clips 47 and 48. The side 33 has the projection 32 while the side 46 has the projection 32*a*.

Now referring to FIG. 6, it will be seen that the sides 33 and 46 are made of metal clips which are angled at their ends as at 49 and 50 relative to the clip 33 and are embedded in the core 45 (see the upper portion of FIG. 6, particularly relative to the end 49).

Figure 8:
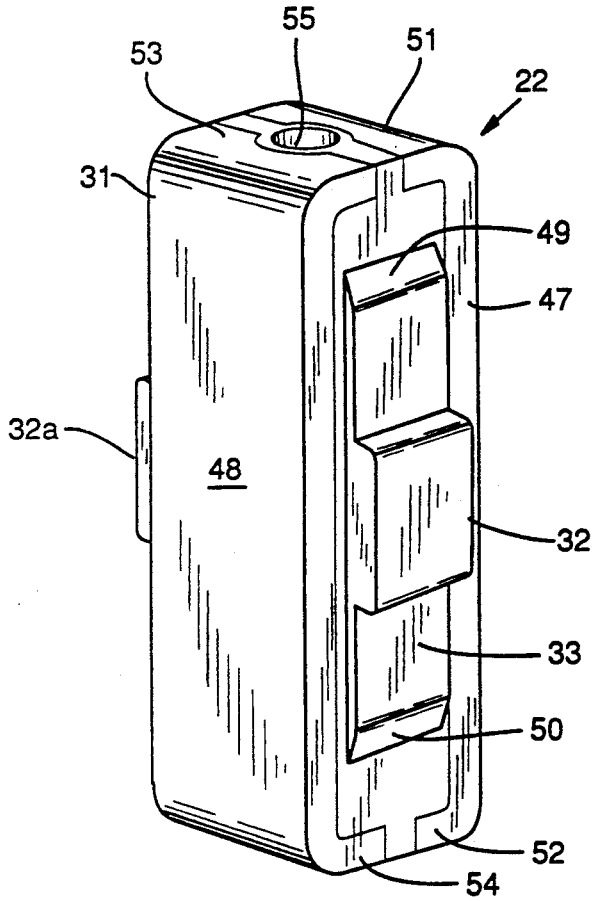
FIG. 8 is a perspective view of the locking pin.

As seen best in FIG. 8, the opposing clips 47 and 48 are equipped with end flanges as at 51 and 52 relative to the clip 47 and as at 53 and 54 relative to the clip 48. The end flanges 51–54 provide a metal surface for driving the lock in and removing it and as a stop for vertical movement during installation and removal. The inwardly tapered ends of the clips 33, 46 as at 49, 50 assist in squeezing the elastomeric body 45 and also serve to squeeze the projections 32, 32*a* inwardly during installation and thereby facilitate positive seating. Thus, there is provided a fully metal jacketed rubber or like elastomeric pin which functions when installed like the prior art solid steel pins yet which has advantageous and unusual resiliency. The close fit of the clips 33 and 46–48 loads the elastomeric core 45 tightly so that there is positive outward force on all four sides exerted when the locking pin is installed. This is further assisted by providing a longitudinally extending hole or opening 55 in the resilient core 45 and which is seen to be compressed into a generally oval shape 55' in FIG. 5.

Figure 5:
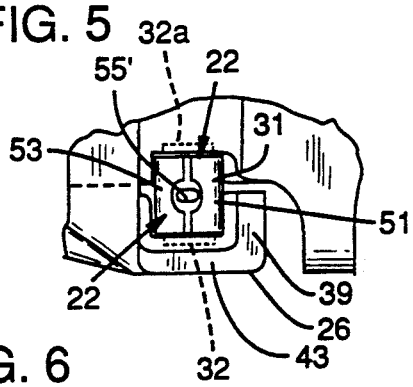
FIG. 5 is a fragmentary top plan view such as would be seen along the sight line 5'5 applied to FIG. 4.
Figure 9:
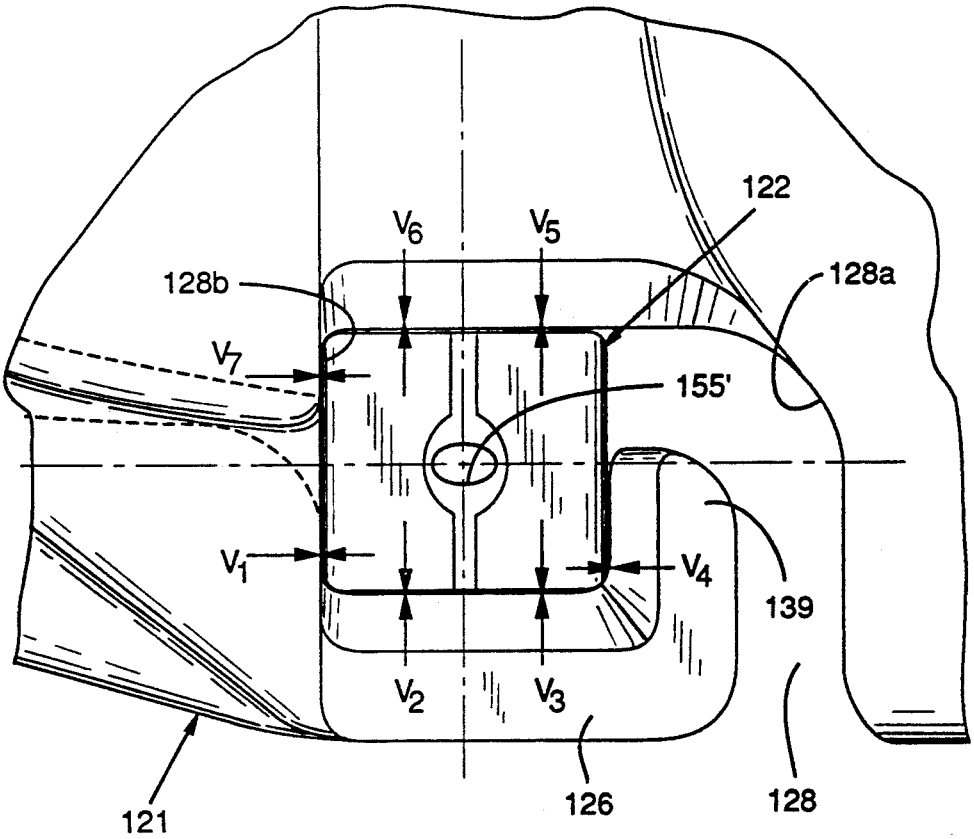
FIG. 9 is an enlarged view similar to FIG. 5.

Referring now to FIG. 9 which is an enlargement of a construction similar to FIG. 5, the force vectors applied by and to the locking pin 22 during earth working can be seen. The only difference between the showings in FIG. 5 and FIG. 9 lies in the relocation of the rear wall of the slot 28. This can be appreciated relative to the embodiment of FIG. 5 by reference to FIG. 1 where the rear wall of the slot 28 is designated 28*a*. In FIG. 9, this wall is substantially moved rearwardly to the position 128*a* without any effect on the operation of the inventive tooth. It will be appreciated that the rear wall 28*a* of the slot 28 or the rear wall 128*a* of the slot means 128 performs no function in confining the locking pin. The locking pin is clamped along its rear side by the inwardly extending flange means 39 or 139. As the pin is installed, it bears against the flange means 39, 139 to force the point tighter onto the adapter and having a bearing provided by the rear wall 28*a* of the slot 28 would interfere with this operation.

Now referring specifically to FIG. 9, it is seen that the locking pin generally designated 122 has a plurality of force vectors applied thereto. Those extending outwardly of the generally rectangular pin 122 are developed by the push or resiliency of the elastomeric core against the vertical side clips. The arrows pointing toward the pin 122 represent the reaction from the mating areas in the point, tongue and nose. For example, the vector $V_1$ is the reaction force of the point on the pin 122. The vectors $V_2$, $V_3$ and $V_4$ are those representing the reaction forces of the tongue 126 on the pin 122. Lastly, the vectors designated $V_5$, $V_6$ and $V_7$ are those generated by the reaction of the adapter nose. This demonstrates how the locking pin 122 bears on all four sides in the three part assembly of point, adapter, nose and lock. It is this combination of forces that results in the distortion of the central longitudinal hole 55 to the shape 155 in FIG. 9.

Important in this respect insofar as the point 21 or 121 is concerned is the provision of the inwardly facing recess 34. For the smaller size points to which the invention advantageously applies, this recess is generally rectangular to conform to the shape of the projection 32 in the clip 33. Excellent results are obtained when the projection 32 has a vertical dimension of about 0.375" (9.5 mm.) and a horizontal dimension of about 0.300" (7.6 mm.). The clip 33 has an overall height of about 1.73" (43.9 mm.) with the ends at 49 and 50 being angled inwardly at an angle of about 15°. It will be appreciated that the operational advantages are not limited to these dimensions.

Operation

It is believed that the operation of the invention can be best understood by a discussion of the steps employed for replacing a worn point—this being relevant in view of the shorter wear life of points as contrasted to adapters.

The adapter 20 is a relatively elongated unitary metal body having a forwardly projecting nose 24 at one end. Normally, the nose is defined by upper and lower walls flanked by slightly forwardly convergent sidewalls and is equipped with a plurality of helical thread means projecting outwardly of the nose. The adapter has a shank portion 23 rearwardly of the nose for mounting the adapter on excavating equipment as by bolting, welding, etc. At least one of the nose sidewalls 29 is equipped with a vertically extending outwardly facing slot means 28, 128 which has a forward generally planar forward wall (designated 128*b* only in FIG. 9).

The worn point is usually characterized by a loss of penetrating edge 21*a* and is generally wedge-shaped. The point 21 includes a relatively elongated unitary metal body having the aforementioned digging edge 21*a* at its forward end and a socket 27 extending forwardly from its rear end. The socket 27 has interior walls conforming to the nose upper, lower and sidewalls and also the thread means 25. At least one of the point sidewalls has an integral tongue 26 extending rearwardly of the point rear end. The tongue at the rear end is equipped with an integral, inwardly extending flange 39, 139 to provide a slot 30 aligned with the nose slot means 28, 128. The tongue is characterized by a top surface 40, a bottom surface 41, an inner surface 35 and an outer surface 42. The inner surface 35 is equipped with a recess 34 intermediate the top and bottom surfaces 40, 41. An elongated pin generally designated 22 and specifically designated 31 is mounted in the aligned slot 30 and slot means 28, 128. The pin 31 has a generally rectangular cross section defined by forward, rear, inner and outer sidewalls developed by clips 48, 47, 46 and 33, respectively. The outer sidewall 33 is equipped with an outwardly extending resilient projection 32 received in the recess 34.

The method steps include exerting a force on the end of the pin 31 to drive the pin vertically followed by a continuation of exertion of the force until the pin is completely removed from the aligned slot 30 and slot means 28, 128. This loosens the worn point whereupon the worn point can be rotated on the thread means 25 sufficient to permit longitudinal translation of the point 21 on the nose 24. This is followed by removing the worn point 21 from the nose 24 and providing a new point also having a recess-equipped tongue 26.

Next, the new point is installed on the nose 24 first by longitudinal and thereafter rotational movement relative to the nose 24 to generally align the slot means 28, 128 of the adapter nose 24 and the slot 30 of the new point 21. Next, a new pin 31 is installed in the aligned slot and slot means 30, 28 or 128. This new pin again has an outwardly resilient projection 32. Thereafter a downward force is exerted on the upper end of the reinstalled new pin to drive the projection 32 into guiding engagement with the nose and point and place the projection 32 in the recess 34.

While in the foregoing specification a detailed description of the invention has been set down for the purpose of illustration, many variations in the details hereingiven may be made by those skilled in the art without departing from the spirit and scope of the invention.

What is claimed is:

1. A replacement point for an excavating tooth comprising relatively elongated, unitary body having an earth engaging edge at the body forward end and an adapter nose-receiving socket in the body rear end, said socket being defined by generally horizontal top and bottom walls and a pair of generally vertical sidewalls, at least one of said sidewalls extending rearwardly beyond said top and bottom walls to provide a rearwardly-extending tongue, said tongue at the rear end thereof being equipped with integral, inwardly extending flange means providing a generally vertical surface adapted to confine a locking pin, said tongue having top, bottom inner and outer surfaces, said inner surface being equipped with a recess having generally horizontal top and bottom recess walls extending generally parallel to said tongue top and bottom surfaces, said top and bottom recess walls being adapted to engage a locking pin projection.

2. The replacement point according to claim 1 in which said inner surface adjacent said top surface is angled toward said outer surface.

3. The replacement point according to claim 2 in which said inner surface adjacent said bottom surface is similarly angled toward said outer surface.

4. The replacement point according to claim 1 in which each of said sidewalls extends rearwardly beyond said top and bottom walls to provide rearwardly-extending tongues, each said tongue at the rear end thereof being equipped with integral, inwardly extending flange means, each said tongue having said recess.

5. The replacement point of claim 4 in which each said inner surface adjacent said top and bottom surfaces is angled toward said outer surface.

6. The replacement point of claim 4 in which said flange means extends between said top and bottom surfaces.

7. A replacement point for an excavating tooth comprising relatively elongated, unitary body having an earth engaging edge at the forward end thereof and an adapter nose-receiving socket in the rear end and defined by top, bottom and a pair of sidewalls, at least one of said sidewalls extending rearwardly beyond said top and bottom walls to provide a rearwardly-extending L-shaped tongue, said L-shaped tongue having a rearwardly-extending leg and an inwardly-extending flange means, said tongue having top, bottom, inner and outer surfaces, said tongue L-shape being provided by a vertically-extending slot in said inner surface, said inner surface of said rearwardly-extending leg being equipped with a generally rectangular recess approximately midway of said top and bottom surfaces and having top and bottom recess walls spaced respectively from said tongue top and bottom surfaces, said top and bottom recess walls being adapted to engage a locking pin projection.

8. An excavating tooth comprising an adapter having a rear end adapted to be mounted on an excavator, said adapter having a nose at the forward end thereof, a relatively elongated point having an earth-engaging forward end and a socket at the rear end thereof, said nose being received in said socket, said point having top, bottom and sidewalls with at least one of said sidewalls extending rearwardly beyond said top and bottom walls to provide a rearwardly extending tongue, said tongue at the rear thereof being equipped with inwardly-extending, integral flange means to provide a pin-receiving slot, said tongue forward of said flange means having top, bottom, inner and outer surfaces, a tongue recess in said inner surface intermediate said top and bottom surfaces, and having recess top and bottom walls extending generally parallel to said tongue top and bottom surfaces, said adapter nose being equipped with vertically extending nose slot means confronting said tongue slot and cooperating therewith to provide a pin-receiving opening, and a locking pin installed in said opening and including an elastomeric core and a metal jacket, said metal jacket having an integral outwardly-extending projection received in said tongue recess between said recess top and bottom walls, said locking pin being confined by said flange means.

9. The excavating tooth according to claim 8 in which said nose slot means has front and rear opposed vertically extending, generally parallel walls in confronting relation to front and rear opposite sides of said pin jacket.

10. The excavating tooth according to claim 8 in which said nose slot means includes a vertically extending wall contacting the forwardly facing side of said pin.

11. The excavating tooth according to claim 8 in which said tongue inner surface is angled toward said tongue outer surface adjacent said top and bottom surfaces.

12. The excavating tooth according to claim 11 in which said nose slot means is equipped with a surface confronting said tongue inner surface, said nose confronting surface being angled inwardly away from said pin adjacent the top and bottom ends of said slot means.

13. An excavating tooth comprising an adapter having a rear end adapted to be mounted on an excavator, said adapter having a nose at the forward end thereof, a relatively elongated point having an earth-engaging forward end and a socket at the rear end thereof, said nose being received in said socket, said point having top, bottom and sidewalls with at least one of said sidewalls extending rearwardly beyond said top and bottom walls to provide a rearwardly extending tongue, said tongue at the rear thereof being equipped with inwardly-extending, integral flange means to provide a pin-receiving slot, said tongue forward of said flange means having top, bottom, inner and outer surfaces, a tongue recess in said inner surface intermediate said top and bottom surfaces, said adapter nose being equipped with vertically extending slot means confronting said tongue slot and cooperating therewith to provide a pin-receiving opening, and a locking pin installed in said opening and including an elastomeric core and a metal jacket, said metal jacket having an integral outwardly-extending projection received in said tongue recess, said pin being relatively vertically elongated and being generally rectangular in transverse plan to provide four vertical sides, said pin metal jacket including two pairs of opposed vertical side clips, one pair of vertical side clips having inwardly extending end flanges for confining said core and providing metal surfaces for impact driving said pin into said opening, the other pair of vertical side clips having angled ends embedded in said core, one of said other pair of vertical side clips being equipped with said outwardly-extending projection.

14. An excavating tooth comprising an adapter having a rear end adapted to be mounted on an excavator, said adapter having a nose at the forward end thereof, a relatively elongated point having an earth-engaging forward end and a socket at the rear end thereof, said nose being received in said socket, said point having top, bottom and sidewalls with at least one of said sidewalls extending rearwardly beyond said top and bottom walls to provide a rearwardly extending tongue, said tongue at the rear thereof being equipped with inwardly-extending, integral flange means to provide a pin-receiving slot, said tongue forward of said flange means having top, bottom, inner and outer surfaces, a tongue recess in said inner surface intermediate said top and bottom surfaces, said adapter nose being equipped with vertically extending slot means confronting said tongue slot and cooperating therewith to provide a pin-receiving opening, and a locking pin installed in said opening and including an elastomeric core and a metal jacket, said metal jacket having an integral outwardly-extending projection received in said tongue recess, said nose slot means being equipped with a recess confronting said tongue recess, said metal jacket having a second projection received in said nose recess.

15. An excavating tooth comprising a relatively elongated, unitary point having an earth engaging edge at the forward end thereof and an adapter nose-receiving socket in the rear end defined by top, bottom and a pair of sidewalls, at least one of said sidewalls extending rearwardly beyond said top and bottom walls to provide an integral, L-shaped tongue having top, bottom, inner and outer surfaces, said L-shaped tongue including a rearwardly-extending leg and inwardly-extending flange means, a recess in the inner surface of said rearwardly-extending leg intermediate the height of said tongue and having recess top and bottom walls extending generally parallel to said tongue top and bottom surfaces, a nose-equipped adapter with the nose thereof received in said socket, and locking pin means interposed between said point and adapter and confined by said flange means, said locking pin means being equipped with a projection resiliently received in said recess between said recess top and bottom walls.

16. The excavating tooth according to claim 15 in which said locking pin is generally rectangular and includes an elastomeric core within a metal jacket.

17. The excavating tooth according to claim 15 in which said rearwardly extending leg has surface segments adjacent the top and bottom thereof inclined away from said pin.

18. The excavating tooth according to claim 15 in which said recess is generally rectangular.

* * * * *